US005341603A

United States Patent [19]

Pollock et al.

[11] Patent Number: 5,341,603

[45] Date of Patent: Aug. 30, 1994

[54] EXTERNAL HONE

[75] Inventors: R. A. Pollock, Ballston Lake; J. F. Van Nest, Schenectady, both of N.Y.

[73] Assignee: General Electric Company, Schenectady, N.Y.

[21] Appl. No.: 910,898

[22] Filed: Jul. 10, 1992

[51] Int. Cl.[5] ..... B24B 7/00

[52] U.S. Cl. ..... 51/73 R; 51/166 R; 51/169

[58] Field of Search ..... 51/73 R, 166 R, 169, 51/429, 290, 326, 168

[56] References Cited

U.S. PATENT DOCUMENTS

| | | | |
|---|---|---|---|
| 1,209,594 | 12/1916 | Kling . | |
| 2,083,685 | 7/1936 | Burkhalter | 51/73 R |
| 2,162,187 | 6/1939 | Tharp | 51/73 |
| 2,163,425 | 6/1939 | Emerson | 51/73 R |
| 2,171,417 | 8/1939 | McGovern et al. | 51/73 |
| 2,291,164 | 7/1942 | Law | 51/73 |
| 2,382,642 | 8/1945 | Klinglesmith | 51/73 R |
| 2,571,779 | 10/1951 | Stodgell | 51/241 |
| 2,715,798 | 8/1955 | Jollivet | 51/73 R |
| 2,865,150 | 12/1958 | Fuglie | 51/73 R |
| 2,994,163 | 8/1961 | Schulze | 51/73 R |
| 4,449,328 | 5/1984 | Gillette et al. | 51/73 |

FOREIGN PATENT DOCUMENTS

| | | | |
|---|---|---|---|
| 345618 | of 1921 | Fed. Rep. of Germany | 51/73 R |
| 317592 | 1/1957 | Switzerland | 51/73 R |

*Primary Examiner*—M. Rachuba

*Attorney, Agent, or Firm*—Nixon & Vanderhye

[57] ABSTRACT

A honing fixture includes a mounting ring 30 carrying a plurality of circumferentially spaced rollers 32. A ring gear 34 rotates about rollers 32 and carries segmented ring segments 40*a* and 40*b* for rotation therewith about a honing axis. Ring segments 40*a* and 40*b* carry honing stones, the segments being pivotally coupled to one another at one end and biased for closing movement toward one another at the opposite end. A suspension structure supports the honing fixture 14 from a support assembly 12 in a manner to compensate for applied torque loading on the honing fixture and its weight. The suspension structure includes a pair of pivoted arms 72 and 74 carrying the weight of the honing fixture at their distal ends and engaging at their proximal ends a spring 90. The honing fixture 14 is mounted for translation movement along guides 18.

18 Claims, 5 Drawing Sheets

EXTERNAL HONE

TECHNICAL FIELD

The present invention relates to an improved hone for conditioning an external surface of a workpiece, e.g., a bearing or a ground surface, without rotation of the workpiece.

BACKGROUND

Most hones are maintained stationary and the workpiece is rotated relative to the hone to recondition the workpiece. This requires substantial effort to set-up the workpiece relative to the honing fixture. Runout checks on the workpiece, particularly for precision honing, additionally require the removal of the workpiece from the hone and rotary device. This, in turn, necessitates additional and repititious set-ups for further honing to the desired surface. Concentricity of the surface to be reconditioned with the original axis of the workpiece is also extremely difficult, if not impossible, to maintain with a fixed hone and a rotating workpiece.

Hones adapted to rotate about a fixed workpiece are, of course, well known. It will be appreciated, however, that when an external hone rotates about a workpiece, a torque is developed, tending to thrust the honing fixture laterally in the direction of rotation. In the absence of compensation for this applied torque, a non-uniform loading on the surface of the workpiece occurs, with the result that the axis of the honing fixture tends to shift relative to the axis of the workpiece. Further, if the weight of the honing fixture and ancillary equipment are applied to the workpiece during honing, the coaxial relation of the workpiece and honing fixture would similarly tend to shift.

DISCLOSURE OF INVENTION

In accordance with the present invention, there is provided a hone which maintains concentricity with the workpiece whose external surface is to be honed, i.e., the honing fixture and workpiece axes are maintained during honing in a coaxial relation one with the other. To accomplish this, the hone support assembly employs a suspension structure which compensates for the weight and thrust of the honing fixture.

According to the present invention, there is provided an external hone which compensates for the weight of the honing fixture and the torque load applied to the rotating honing fixture whereby concentricity of the workpiece and honing fixture and hence a coaxial relation of the axes of the fixture and the workpiece are maintained throughout the honing process. To accomplish the foregoing, the present invention provides a support structure which carries the honing fixture for horizontal movement. The honing fixture per se includes a mounting structure, preferably a mounting ring, carrying a plurality of rollers circumferentially spaced one from the other about the ring, the mounting ring defining a honing axis. A rotatable structure including a ring gear is mounted for rotation about the rollers relative to the mounting ring and carries a plurality of honing stones at spaced circumferential positions thereabout. Preferably, the stones are carried by a stone ring comprised of a pair of semi-circular ring segments. To drive the stone ring about the axis of the honing fixture, a hydraulic motor is mounted on the honing fixture, e.g., the mounting structure, and is coupled to the ring gear by an endless chain. The hydraulic motor drives the chain and ring gear which, in turn, rotates the stones about the axis of the honing fixture, honing the surface of the workpiece disposed coaxially within the honing fixture.

A unique suspension structure for the honing fixture is provided connecting between the support assembly and the honing fixture and which compensates for the weight of the honing fixture and the applied torque load. This suspension assembly includes a pair of generally horizontally disposed, laterally extending support arms each carried on a discrete horizontal pivot intermediate the ends of the support arm by the horizontally movable support assembly. The distal ends of the support arms carry rods which, in turn, are pivotally connected to hangers secured at their lower ends to the mounting ring. These latter pivotal connections form a horizontal axis about which the honing fixture may rotate, i.e., a horizontal axis normal to the honing axis. The free interior or proximal ends of the support arms bear against a spring carried by the support assembly. The weight of the honing fixture is transmitted to the distal ends of the support arms by the hanger and rod on each of the opposite sides of the honing fixture and by the support arms to the spring. The spring effectively carries the weight of the honing fixture. Consequently, the honing fixture essentially floats and has no weight when applied to the workpiece.

The suspension assembly also compensates for the torque load applied to the honing fixture by the motor which rotates the honing stones. By enabling the support arms to pivot in opposite directions as a result of the applied torque loading, movement on one side of the honing fixture is followed by similar movement of the other side of the honing fixture, thus offsetting and counterbalancing the tendency of the fixture to move laterally under the applied torque loading. The suspension assembly therefore compensates for the weight of the honing fixture and its side torque loading to maintain the hone axis coaxial with the original axis of the workpiece and the honing fixture concentric with the surface of the workpiece.

Additionally, and in accordance with the present invention, the mounting ring for the hones is comprised of a pair of semi-circular mounting ring segments, only one of which is secured to the rotatable structure. The segments are pivotally connected one to the other at their proximal ends at one side of the honing fixture. The non-secured segment is spring-biased for movement of its distal end toward the opposite distal end of the secured segment. Consequently, a gap may appear at the juncture of the distal ends of the two segments, with the segments biased for movement toward one another during honing to close the gap. Further, the honing stones are carried by the stone ring for radial movement within a limited range, i.e., movement toward and away from the honing axis. This enables workpieces of different diameters, within the range of movement defined by the radially movable stones, to be honed.

In a preferred embodiment according to the present invention, there is provided an apparatus for externally honing a fixed workpiece having an axis comprising (a) a support assembly, (b) a honing fixture including (i) a mounting structure carried by the support assembly mounting a plurality of rollers circumferentially spaced one from the other and defining a honing axis; (ii) a rotatable structure carried by the rollers for rotation about the honing axis and relative to the mounting structure; and (iii) means carried by the mounting structure and coupled to the rotatable structure for applying a torque thereto such that the rotatable structure rotates about the honing axis, (c) a plurality of honing stones carried by the rotatable structure for rotation therewith about the honing axis and for engagement with a workpiece for honing the external surface of the workpiece and (d) means coupled between the support assembly and the mounting structure for compensating for the weight of the honing fixture and the torque applied to the rotatable structure such that the workpiece and honing axes are maintained coaxial one to the other during honing.

In a further preferred embodiment according to the present invention, there is provided apparatus for externally honing a fixed workpiece having an axis comprising a support assembly, a honing fixture defining a honing axis and including a mounting structure carried by the support assembly, a rotatable structure carried by the mounting structure for rotation about the honing axis and relative to the mounting structure, and means carried by the honing fixture and coupled to the rotatable structure for applying a torque thereto such that the rotatable structure rotates about the axis, a plurality of honing stones connected to the rotatable structure for rotation therewith about the honing axis and for engagement with a workpiece for honing the external surface of the workpiece, support arms coupled to the support assembly and the mounting structure on opposite sides of the honing axis and independently pivotal relative to one another and biasing means enabling the support arms to pivot in substantially equal increments in opposite directions in response to an applied torque whereby any tendency of the honing fixture to be displaced laterally in response to the applied torque is resisted by the biasing means.

Accordingly, it is a primary object of the present invention to provide a novel and improved honing apparatus for externally honing a fixed workpiece.

BEST MODE FOR CARRYING OUT THE INVENTION

Reference will now be made in detail to a present preferred embodiment of the invention, an example of which is illustrated in the accompanying drawings.

Figure 1:
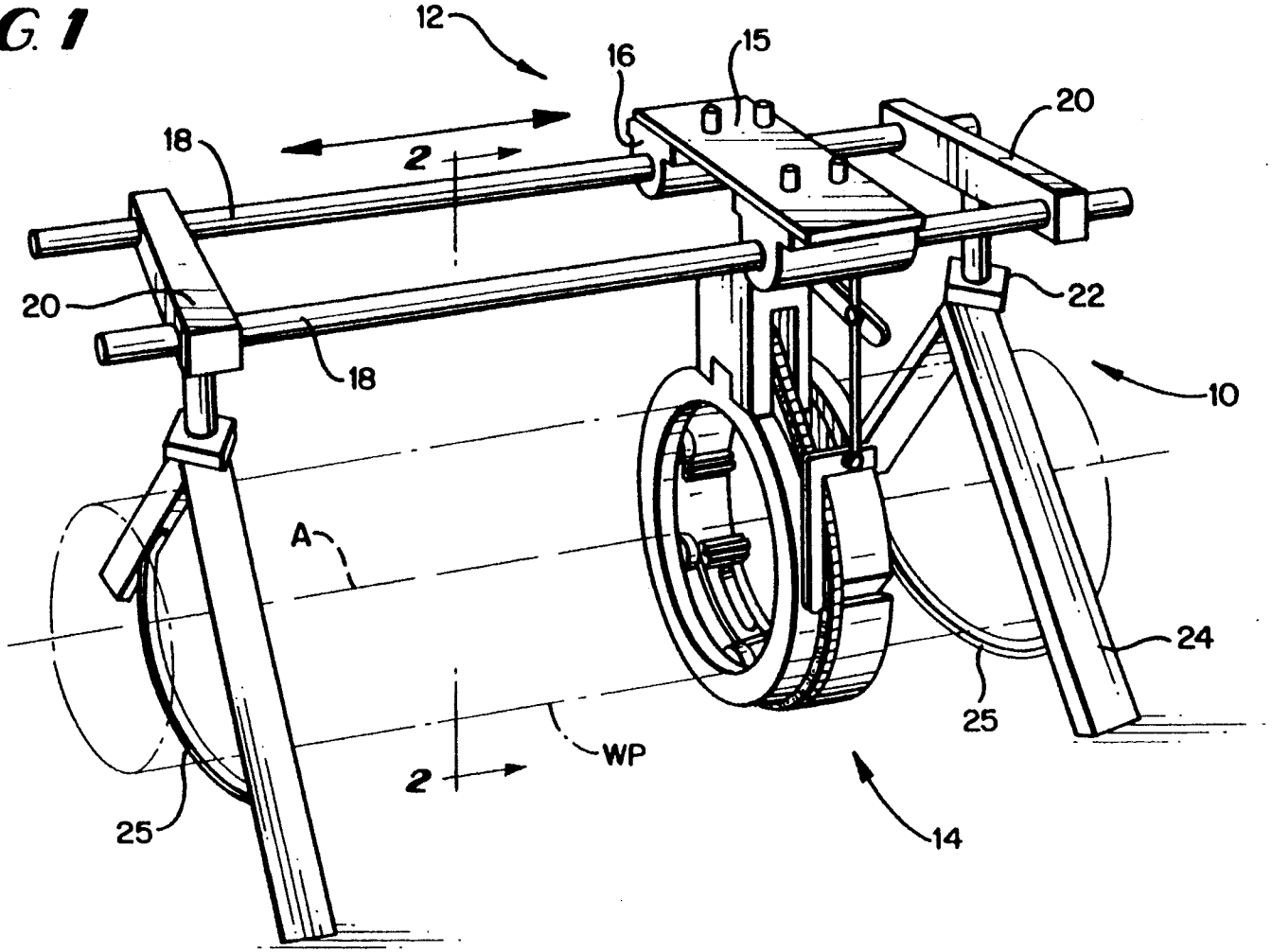
FIG. 1 is a perspective view of an apparatus for externally honing a fixed workpiece according to the present invention.

Referring now to FIG. 1, there is illustrated a honing apparatus according to the present invention, generally indicated 10, including a support assembly, generally designated 12, for carrying a honing fixture, generally designated 14. Support assembly 12 includes a top plate 15 mounting along its underside a pair of laterally spaced pillow blocks 16 slidable on longitudinally extending, horizontally spaced bars 18. Bars 18 are supported at their opposite ends by crossbars 20, in turn, supported by uprights 22 which are adjustable in height. The lower ends of uprights 22 are, in turn, supported by respective pairs of outwardly diverging support legs 24. The support legs 24 adjustably carry a strap 25 between the legs for securing a workpiece WP between the legs and the undersides of the legs. FIG. 1 illustrates the honing fixture 14 in position for honing a workpiece WP having an axis A, the workpiece WP being carried by the straps 25 between the pairs of legs. It will be appreciated that support plate 15 and pillow blocks 16 are slidable horizontally along guide bars 18 and that the honing fixture 15 is carried for horizontal movement therewith in directions parallel to axis A.

Figure 2:
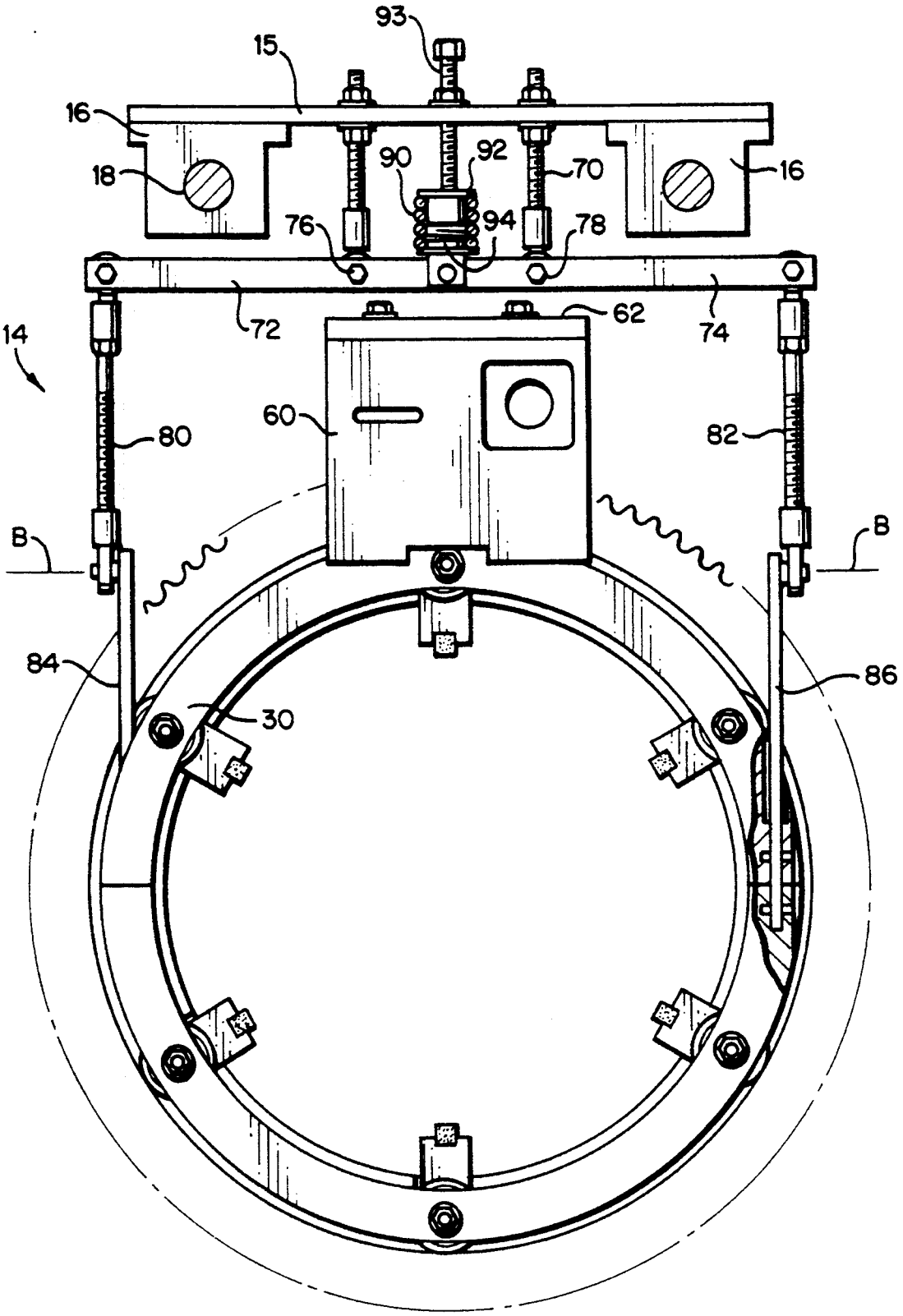
FIG. 2 is a cross-sectional view thereof taken about on line 2—2 in FIG. 1 and illustrating a support assembly for a honing fixture, and with parts broken out and in cross-section for ease of illustration.
Figure 3:
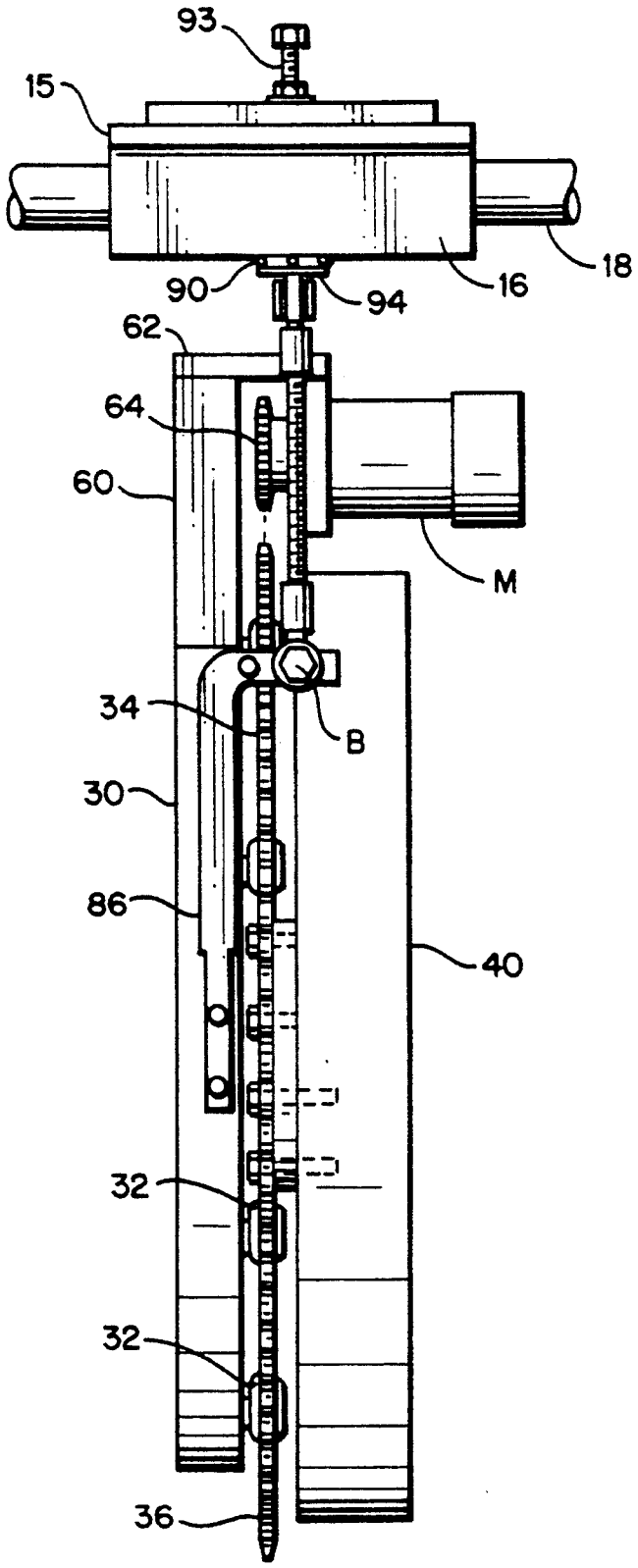
FIG. 3 is a side elevational view of the honing apparatus with parts removed for clarity.
Figure 4:
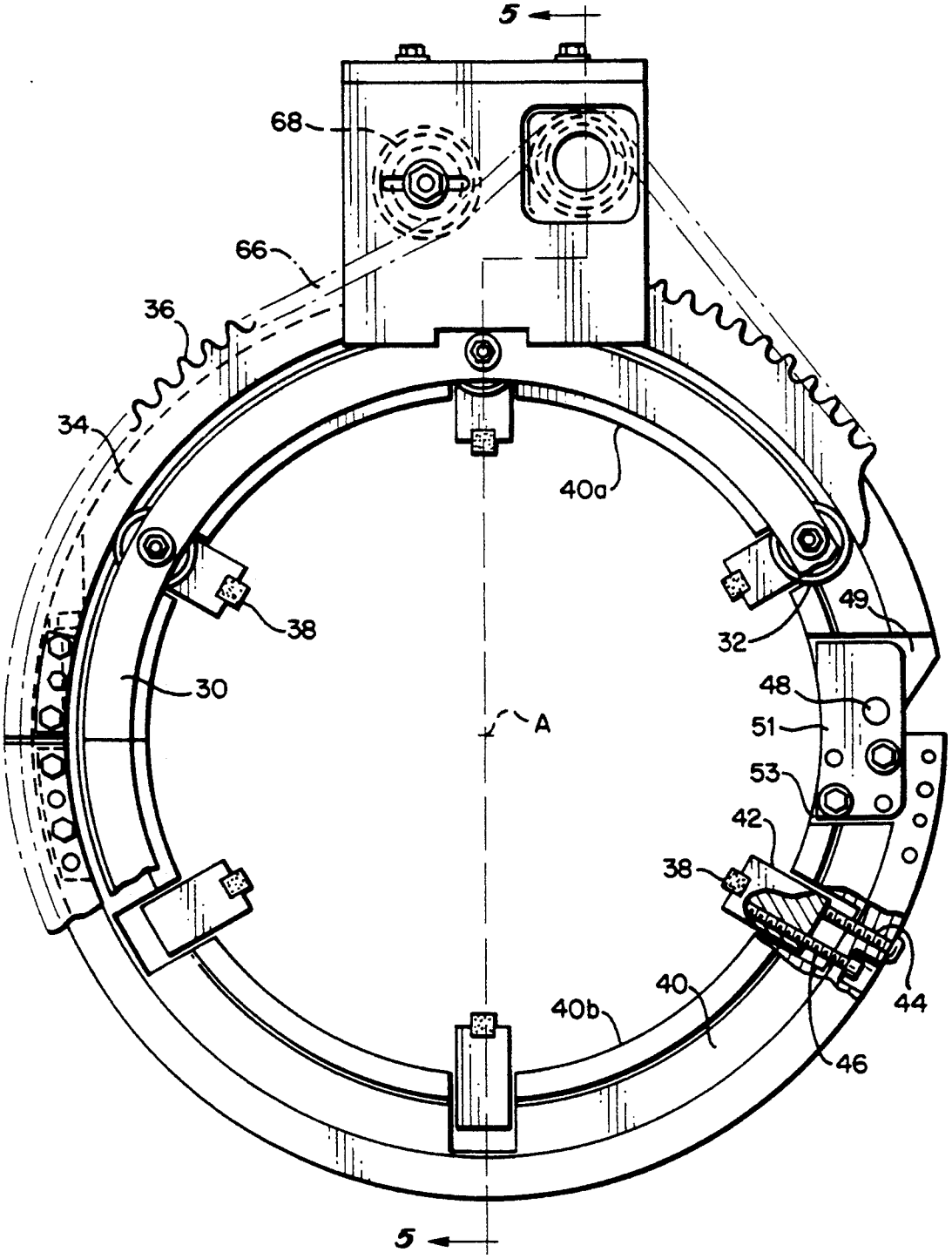
FIG. 4 is a view similar to FIG. 2 illustrating the honing fixture in greater detail.
Figure 5:
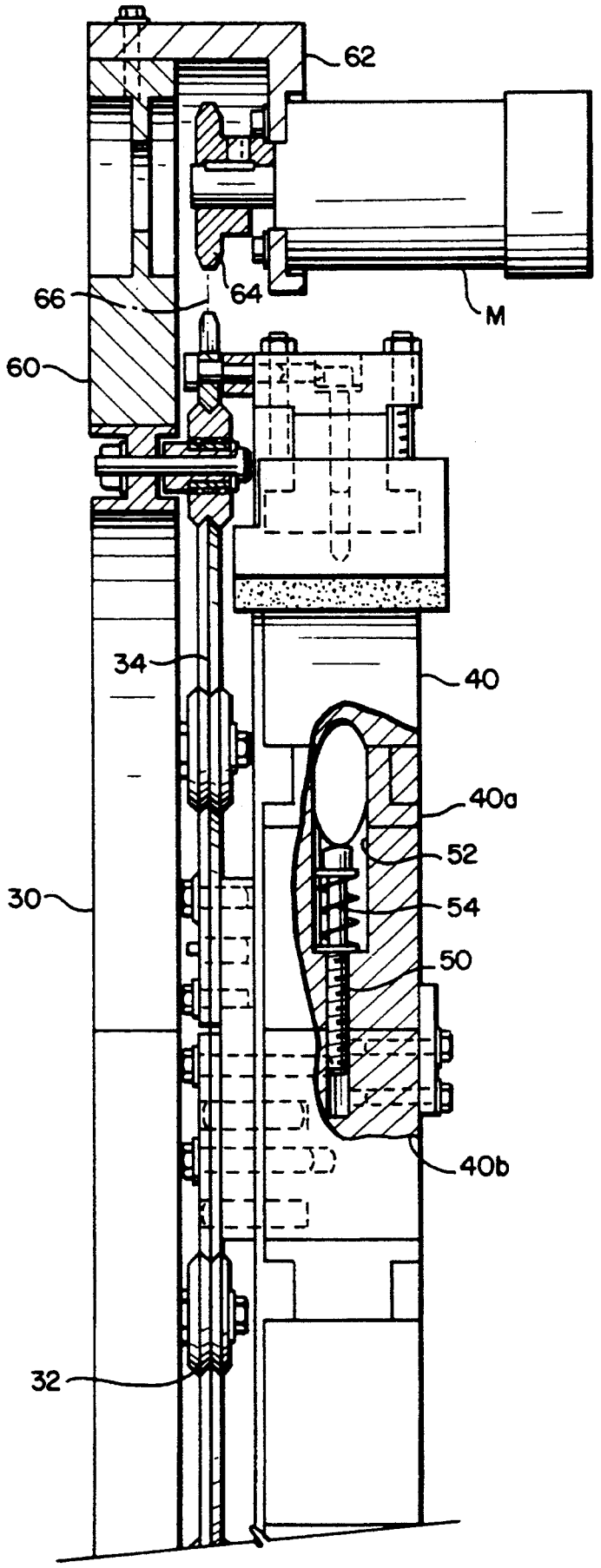
FIG. 5 is a cross-sectional view thereof taken generally about on line 5—5 in FIG. 4.

Referring now particularly to FIGS. 2–5, honing fixture 14 includes a mounting structure preferably comprising a mounting ring 30 carrying a plurality of rollers 32 at circumferentially spaced positions about ring 30. Rollers 32 project axially to one side of ring 30 and are mounted for rotation about horizontal axes. A rotatable structure, preferably comprising a ring gear 34 having external teeth 36, is mounted for rotation on rollers 32 about an axis coincident with the axis of mounting ring 30 and which defines a honing axis for honing workpiece WP. A plurality of honing stones 38 are carried by the rotatable honing structure for rotation therewith and about the honing axis. Preferably, stones 38 are carried on a segmented stone ring 40 and are preferably equally circumferentially spaced one from the other. As illustrated in FIG. 4, each stone 38 is mounted on a stone holder 42 which is mounted on the stone ring 40 for adjustable radial movement toward and away from axis A by means of bolts 44 and 46. Consequently, by adjusting bolts 44 and 46, each stone 38 can be moved radially inwardly or outwardly relative to the honing axis, i.e., relative to the axes of the mounting ring, ring gear and stone ring, whereby workpieces of different diameters within a predetermined range can be honed by the honing apparatus hereof.

Stone ring 40 is formed of two generally semi-circular segments 40*a* and 40*b* pivoted one to the other at adjoining ends by a pin 48 passing through an axially reduced end 49 of ring segment 40*a* and a pair of plates 51 secured to an axially reduced end 53 of segment 40*b*. The stone segment 40*b* is secured by bolts to ring gear 34 whereas the segment 40*a* is secured only to segment 40*b*. The opposite end of segment 40*a* is biased for movement toward segment 40*b* about pin 48 to close the stone ring. To accomplish this, a bolt 50 (FIG. 5) is threaded into the end of lower segment 40*b* and is received in a recess 52 formed in the upper segment. A spring 54 engages between the head of bolt 52 and the base of the recess. The spring thus biases segments 40*a* and 40*b* for closing movement toward one another about pivot pin 48.

Honing fixture 14 also includes a drive block 60 suitably secured to mounting ring 30. A motor mount 62 is connected to drive block 60 and mounts a hydraulic motor M. The drive shaft of hydraulic motor M carries a sprocket 64 which drives an endless chain 66 which extends about ring gear 34. An idler gear 68 (FIG. 4) is also carried by drive block 60 and is adjustable in a lateral direction to adjust the tension on drive chain 66.

Consequently, it will be appreciated that operation of motor M carried by honing fixture 14 drives chain 66 which rotates ring gear 34. Ring gear 34 carries the stone ring 40 for rotation therewith by its bolted connection with segment 40b and the connections between the opposite ends of the segments, i.e., pin 48 and the spring-biased bolt 50. The honing stones 38 are thus carried for rotation about axis A.

By applying torque to the drive ring and stone ring through chain drive 66, the stones 38 are rotated about the workpiece. This drive also applies a lateral thrust to honing fixture 14. To compensate for this lateral thrust and also to compensate while honing for the weight of honing fixture 14, there is provided a unique suspension structure for coupling honing fixture 14 and support assembly 12. More particularly and with reference to FIG. 2, the suspension structure includes a pair of laterally spaced threaded support rods 70 secured at their upper ends to top plate 15. Rods 70 terminate at their lower ends in a pivotal connection with a pair of laterally extending support arms 72 and 74. The inner proximal ends of support arms 72 and 74 are closely spaced to one another but are unconnected. Thus, support arms 72 and 74 are carried at the lower ends of rods 70 for pivotal movement about discrete horizontal pivotal axes, designated 76 and 78. The distal ends of support arms 72 and 74 pivotally carry support rods 80 and 82 which pivotally connect at their lower ends to hangers 84 and 86. The lower ends of hangers 84 and 86 are secured to the mounting ring 30 as illustrated in FIG. 2. Hangers 84 and 86, as illustrated in FIG. 3, comprise inverted L-shaped members whereby honing fixture 14, including the mounting ring, ring gear and stone ring, as well as the drive motor M, are pivotally mounted for movement about a horizontal axis B (FIGS. 2 and 3) defined by the pivotal connection between rods 80, 82 and hangers 84, 86.

Turning back to FIG. 2, a helical coil spring 90 is disposed between a spring top 92 and a spring bottom 94. The spring bottom rests on the proximal ends of support arms 72 and 74. Spring top 92 is carried on the lower end of a bolt 93 threadedly and adjustably received in the plate 14. Thus, the elevation of the spring top can be adjusted to adjust the tension in the spring 92.

From a review of FIG. 2, it will be appreciated that the weight of the honing fixture is carried essentially by spring 90 by the pivoting action of support arms 72 and 74 about pivots 76 and 78, respectively. Thus, with respect to FIG. 2, the weight of honing fixture 14 tends to rotate support arm 72 in a counterclockwise direction about pivot 76 and support arm 74 in a clockwise direction about pivot 78. Those opposite rotational movements are resisted by spring 90 and effectively the weight of the honing fixture is thereby transferred to the spring.

It will also be appreciated that the torque or lateral loading applied by the drive motor M to the ring gear and stone ring tending to displace the fixture 14 laterally is compensated for by this suspension structure. Particularly, when the honing fixture tends to be displaced laterally, e.g., to the left in FIG. 2, by its motor drive, support arm 72 will pivot clockwise about pivot 76. However, spring 90 will follow that movement at the proximal end of support arm 72 and will cause the proximal end of support arm 74 to follow that movement. Support arm 74 will thus pivot in a counterclockwise direction, tending to raise the opposite side of the honing fixture. The tendency of fixture 14 to move laterally in response to the applied torque is thus zeroed out by the torque compensation provided by the suspension structure.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. Apparatus for externally honing a fixed workpiece having an axis comprising:

(a) a support assembly;

(b) a honing fixture including (i) a mounting structure carried by said support assembly mounting a plurality of rollers circumferentially spaced one from the other and defining a honing axis; (ii) a rotatable structure carried by said rollers for rotation about said honing axis and relative to said mounting structure; and (iii) means carried by said honing fixture and coupled to said rotatable structure for applying a torque thereto such that said rotatable structure rotates about said honing axis;

(c) a plurality of honing stones carried by said rotatable structure for rotation therewith about said honing axis and for engagement with a workpiece for honing the external surface of the workpiece; and (d) means coupled between said support assembly and said mounting structure for compensating for the weight of the honing fixture and the torque applied to said rotatable structure such that the workpiece and honing axes are maintained coaxial one to the other during honing.

2. Apparatus according to claim 1 including means carried by said rotatable structure for adjusting the radial distance of said honing stones relative to said honing axes.

3. Apparatus according to claim 1 wherein said compensating means comprises a suspension structure including a pair of support arms connected to said support assembly for pivotal movement about spaced generally parallel horizontal axes, support brackets connecting between said mounting structure on opposite sides of said honing axis and said support arms at a location such that the weight of said honing fixture tends to pivot said support arms in opposite directions about said horizontal axes, respectively, and means engageable with said support arms for resisting rotation of one support arm about its horizontal axis in one direction while enabling rotation of the other support arm about its horizontal axis in the other direction.

4. Apparatus according to claim 3 wherein said resisting means includes a spring cooperable between said support assembly and said support arms.

5. Apparatus according to claim 1 wherein said torque applying means includes a hydraulic motor carried by said mounting structure, said rotatable structure including a ring gear for rotation about said rollers and a flexible endless drive chain coupled between said motor and said ring gear for driving said ring gear.

6. Apparatus according to claim 1 wherein said support assembly includes a slide bar for mounting said honing fixture for horizontal translational movement.

7. Apparatus according to claim 1 including means carried by said rotatable structure for adjusting the radial distance of said honing stones relative to said honing axis, said compensating means comprising a suspension structure including a pair of support arms connected to said support assembly for pivotal movement about spaced generally parallel horizontal axes, support brackets connecting between said mounting structure on opposite sides of said honing axis and said support arms at a location such that the weight of said honing fixture tends to pivot said support arms in opposite directions about said horizontal axes, respectively, and means engageable with said support arms for resisting rotation of one support arm about its horizontal axis in one direction while enabling rotation of the other support arm about its horizontal axis in the other direction, said resisting means including a spring cooperable between said support assembly and said support arms, said torque applying means including a hydraulic motor carried by said mounting structure, said rotatable structure including a ring gear for rotation about said rollers and a flexible endless drive chain coupled between said motor and said ring gear for driving said ring, said support assembly including a slide bar for mounting said honing fixture for horizontal translational movement.

8. Apparatus for externally honing a fixed workpiece having an axis comprising:

a support assembly;

a honing fixture defining a honing axis and including a mounting structure carried by said support assembly, a rotatable structure carried by said mounting structure for rotation about said honing axis, and means carried by said honing fixture and coupled to said rotatable structure for applying a torque to said rotatable structure such that said rotatable structure rotates about said axis;

a plurality of honing stones connected to said rotatable structure for rotation therewith about said honing axis and for engagement with a workpiece for honing the external surface of the workpiece;

support arms coupled to said support assembly and said mounting structure on opposite sides of said honing axis and independently pivotal relative to one another; and biasing means enabling said support arms to pivot in substantially equal increments in opposite directions in response to an applied torque whereby any tendency of said honing fixture to be displaced laterally in response to said applied torque is resisted by said biasing means.

9. Apparatus according to claim 8 wherein said support arms are pivotal about axes generally parallel to said honing axis.

10. Apparatus according to claim 8 wherein said support arms are pivotal about axes spaced on opposite sides of a vertical plane passing through and containing said honing axis.

11. Apparatus according to claim 8 wherein said support arms are connected to said support assembly for pivotal movement about laterally spaced generally parallel axes, support brackets connecting between said mounting structure on opposite sides of said honing axis and distal ends of said support arms, said biasing means including a spring carried by said support assembly and engaging the proximal ends of said support arms.

12. Apparatus according to claim 8 including means connecting said support assembly and a said honing fixture for pivotal movement of said fixture about a horizontal axis normal to said honing axis.

13. Apparatus according to claim 8 wherein said mounting structure includes a mounting ring carrying a plurality of rollers circumferentially spaced one from the other about said mounting ring, said rotatable structure including a ring gear mounted for rotation about said rollers, a drive motor carried by said honing fixture and an endless chain coupled between said drive motor and said ring gear for rotating said gear.

14. Apparatus according to claim 8 wherein said support arms are pivotal about axes generally parallel to said honing axis and spaced laterally on opposite sides of a vertical plane passing through and containing said honing axis, support brackets connecting between said mounting structure and distal ends of said support arms on opposite sides of said honing axis, said biasing means including a spring carried by said support assembly and engaging the proximal ends of said support arms.

15. Apparatus according to claim 14 including means connecting said support assembly and said honing fixture mounting said fixture for pivotal movement about a horizontal axis normal to said honing axis.

16. Apparatus according to claim 15 wherein said mounting structure includes a mounting ring carrying a plurality of rollers circumferentially spaced one from the other about said mounting ring, said rotatable structure including a ring gear mounted for rotation about said rollers, a drive motor carried by said honing fixture and an endless chain coupled between said drive motor and said ring gear for rotating said gear.

17. Apparatus according to claim 8 including means carried by said rotatable structure for adjusting the radial distance of said honing stones relative to said honing axis.

18. Apparatus according to claim 8 wherein said rotatable structure includes a pair of semi-circular ring segments pivotally coupled at adjoining ends thereof and means for biasing at least one ring segment for closing movement toward the other ring segment.

* * * * *